United States Patent [19]

Formanack et al.

[11] Patent Number: 4,818,833

[45] Date of Patent: Apr. 4, 1989

[54] APPARATUS FOR RADIANTLY HEATING BLADE TIPS

[75] Inventors: James D. Formanack, Jupiter; Charles M. Biondo, West Palm Beach; Chris C. Rhemer, Jupiter, all of Fla.

[73] Assignee: United Technologies Corporation, Hartford, Conn.

[21] Appl. No.: 135,955

[22] Filed: Dec. 21, 1987

[51] Int. Cl.[4] ..... H05B 6/14

[52] U.S. Cl. ..... 219/10.57; 219/10.491; 219/10.79

[58] Field of Search ..... 219/10.43, 10.79, 10.57, 219/10.71, 10.53, 10.73, 10.67, 10.491

[56] References Cited

U.S. PATENT DOCUMENTS

| | | | |
|---|---|---|---|
| 2,448,690 | 9/1948 | Storm | 219/10.57 X |
| 2,572,646 | 10/1951 | Mgnzel et al. | 219/10.53 X |
| 3,397,297 | 8/1968 | McCorry | 219/10.71 |
| 3,727,022 | 4/1973 | Hamilton | 219/10.57 X |
| 3,926,415 | 12/1975 | Konas et al. | 219/10.73 X |
| 4,102,955 | 7/1978 | Baker et al. | 264/25 |
| 4,136,276 | 1/1979 | Ashe | 219/378 |
| 4,148,494 | 4/1979 | Zelahy et al. | 277/53 |
| 4,177,661 | 12/1979 | Schwarzbach et al. | 72/128 |
| 4,227,703 | 10/1980 | Stalker et al. | 277/53 |
| 4,232,995 | 11/1980 | Stalker et al. | 415/172 A |
| 4,237,359 | 12/1980 | Röth | 219/10.67 |
| 4,249,913 | 2/1981 | Johnson et al. | 51/295 |
| 4,305,115 | 12/1981 | Armitage | 361/437 |
| 4,390,320 | 6/1983 | Eiswerth | 416/97 R |
| 4,424,066 | 1/1984 | Sarin et al. | 51/295 |
| 4,435,815 | 3/1984 | Evensen | 373/81 |
| 4,438,310 | 3/1984 | Cachat | 219/10.43 |
| 4,501,943 | 2/1985 | Lund | 218/10.43 |
| 4,523,068 | 6/1985 | Lund et al. | 219/10.53 |
| 4,563,329 | 1/1986 | Morishita et al. | 419/9 |
| 4,589,823 | 5/1986 | Koffel | 416/92 |
| 4,596,746 | 6/1986 | Morishita et al. | 428/458 |
| 4,604,510 | 8/1986 | Laughlin et al. | 219/10.43 |
| 4,608,128 | 8/1986 | Farmer et al. | 204/16 |
| 4,610,698 | 9/1986 | Eaton et al. | 51/295 |
| 4,622,445 | 11/1986 | Matsen | 219/10.41 |
| 4,627,896 | 12/1986 | Nazmy et al. | 204/37.1 |

*Primary Examiner*—Philip H. Leung
*Attorney, Agent, or Firm*—James M. Rashid

[57] ABSTRACT

An abrasive, wear resistant layer is applied to the tip surface of a superalloy gas turbine blade by high temperature sintering operation which produces a high strength bond between the layer and the blade, minimizes gamma prime phase growth, and prevents recrystallization in the blade. Important features of the invention include the use of an inductively heated graphite susceptor to heat the blade, and a refractory metal shield which surrounds the airfoil and root portions of the blade while leaving the tip portion exposed to the heat source.

4 Claims, 3 Drawing Sheets

APPARATUS FOR RADIANTLY HEATING BLADE TIPS

This invention was made with United States Government support under a contract awarded by the Department of the Air Force. The Government has certain rights in this invention.

CROSS REFERENCE

Attention is directed to the copending and commonly assigned patent application entitled "A Method for Making a Turbine Blade Having a Wear Resistant Layer Sintered to the Blade Tip Surface", U.S. Ser. No. 135,956 filed by R. P. Schaefer et al concurrently with this application.

1. Technical Field

This invention relates to radiant heating, and in particular, to apparatus for locally heating the blade tip portion of a turbine blade using an inductively heated susceptor.

2. Background

Gas turbine engines and other similar types of turbomachines include axially spaced apart stages of disks which rotate within a generally cylindrical engine case. Attached to each disk are blades which extend radially outwardly from the engine axis of rotation, towards the case wall and across a gas flowpath. In order to increase the operating efficiency of these types of engines, the amount of gas in the flowpath which leaks through the space between the radially outer end of the blade (its blade tip) and the case wall should be minimized. In some engines, this is accomplished by a design in which the blade tips rub against the case wall as the disks rotate. To make the blade tips less prone to wear, abrasive particulates are sometimes incorporated in a metal matrix which is bonded or otherwise attached to the tip surface. Such wear resistant layers are shown in, for example, U.S. Pat. Nos. 4,249,913 to Johnson et al; 4,227,703 to Stalker et al; 4,232,995 to Stalker et al; 4,390,320 to Eiswerth; 4,589,823 to Koffel; and 4,610,698 to Eaton et al. These patents describe numerous techniques for making a wear resistant layer and applying it to the blade tip surface. Powder metallurgy, electroplating, brazing, and plasma spray techniques are among those mentioned as being useful.

The blades used in modern gas turbine engines are fabricated from high temperature nickel base superalloys and have either a columnar grain or single crystal microstructure. See, e.g., U.S. Pat. Nos. 3,711,337 to Sullivan and 4,209,348 to Duhl et al. These blades owe their desirable high temperature properties to an optimum microstructure, characterized in part by cuboidal gamma prime phase particles uniformly distributed in a gamma phase matrix. When a wear resistant layer is applied to the tip surface of such blades, the processes used to apply the layer must not adversely affect this optimum microstructure.

In particular, the process shall not substantially alter the size, shape, or distribution of the gamma prime phase particles, and should not introduce extraneous grains (or crystals) in the microstructure, such as by recrystallization. Recrystallization is especially undesired, since the boundaries of the new grains it produces can be perpendicular to the primary stress axis of the blade, and are prone to cracking during service Because of the usefulness of the wear resistant layers in gas turbine engines, engineers continually search for improved apparatus and methods for making them. This invention describes an apparatus and method which offers several advantages over those of the prior art.

SUMMARY OF THE INVENTION

This invention generally relates to an apparatus specifically adapted for radiantly heating the tip portion of a gas turbine engine blade. More specifically, it relates to an apparatus for sintering a wear resistant layer containing ceramic particulates and metal powder particles to the tip surface of a nickel base superalloy turbine blade. The radiant heat source used in this invention is a graphite susceptor having heating chambers defined by slots which extend into the susceptor. The size of each slot is slightly greater than the size of the blade tip which is disposed in the slot during the heating cycle. A refractory metal shield surrounds a portion of the blade, and reflects heat away from the airfoil and root portions while the tip portion is being heated; the tip portion protrudes out of the shield. To achieve the necessary temperature gradients required for successfully heating only the tip portion of the blade, the blade (partially surrounded by the shield) is slowly raised into the susceptor slot so that only the tip is within the slot. After a predetermined amount of time, the blade is lowered out of the susceptor, and the blade is allowed to cool. The shield is preferably fabricated from tantalum sheet metal and has a box shaped structure. In one embodiment of the invention, the tip portion extends through an airfoil shaped slot in the top surface of the shield, the top surface being non-parallel with the tip surface of the blade.

The details of the present invention will become more apparent from the following description of preferred embodiments and the accompanying drawings

BEST MODE FOR CARRYING OUT THE INVENTION

The invention is described in terms of sintering a wear resistant layer to the tip surface of a nickel base superalloy gas turbine engine blade. However, it should be noted that other components which require a durable, wear resistant surface layer can be fabricated according to the methods described below.

Figure 1:
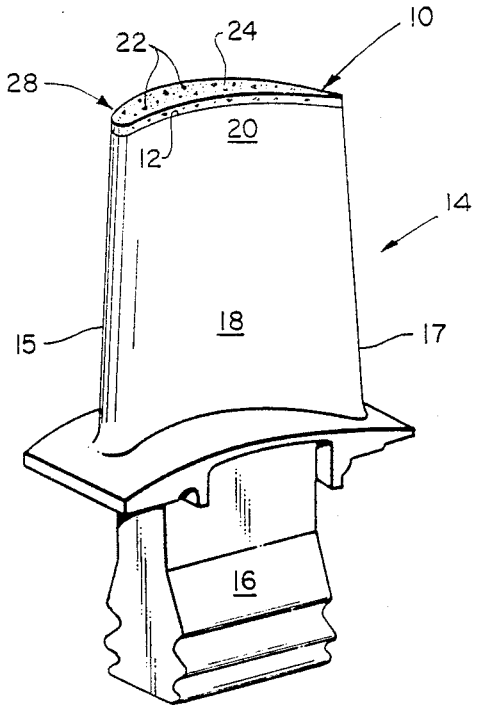
FIG. 1 is a simplified view of an abrasive layer on the tip surface of a turbine blade used in a gas turbine engine.

FIG. 1 shows a wear resistant layer 10 fabricated according to this invention, on the tip surface 12 of a gas turbine engine blade 14. The blade has a root portion 16, an airfoil portion 18, and a tip portion 20 at the radially outer end of the blade 14. It also has a leading edge 15 and a trailing edge 17.

The blade 14 preferably has a single crystal microstructure, although the invention is equally useful with blades that have a columnar grain or equiaxed grain microstructure. Single crystal blades are preferred, as they have the levels of strength which are required for use in advanced gas turbine engines. Single crystal components derive their high strength, in part, from an optimized distribution of cuboidal gamma prime phase particles in a gamma phase matrix, and from the absence of grain boundaries. The optimum size of the gamma prime phase should be in the range of about 0.2–0.5 microns (0.008–0.020 mils). The tip portion of the blade 14 is usually subject to lower operating stresses than the airfoil portion 18 of the blade 14, and some deviation in the optimum gamma prime size at the blade tip portion 20 is permitted. In particular, the size of the gamma prime near the blade tip 20 may be somewhat larger, perhaps up to about 0.7 microns (0.028 mils). However, because of the adverse effects of recrystallization on the mechanical properties of single crystal components, there should be no recrystallized grains in the microstructure.

The wear resistant layer 10 of this invention is characterized by a uniform distribution of abrasive particulates 22 within a high temperature metal alloy matrix 24. The preferred abrasive particulate is alumina coated silicon carbide, of the type described in the aforementioned patent to Johnson et al. The alumina coating prevents chemical interaction between the silicon carbide particulates 22 and the metal matrix 24 during fabrication of the wear resistant layer 10 and during service use. The ceramic particulates have a nominal diameter of about 25–625 microns (1–25 mils), depending on the operating requirements of the layer 10. In most cases, the preferred particulate size is about 125–500 (5–20 mils), most preferably about 375 microns (15 mils). Particulates such as those described in U.S. Pat. No. 4,424,066 to Sarin et al (alumina coated SiAlON) may also be used, as long as they do not react with the metal matrix 24 and have the necessary abrasive characteristics and high temperature stability. To fabricate a wear resistant layer having high strength, the matrix 24 should have a nickel or cobalt base superalloy composition, as described in copending and commonly assigned application Ser. No. 947,067 to Schaefer et al.

The initial step in making the layer 10 is to mix the abrasive particulates with metal powder particles having the matrix composition, and with a volatilizable resin, and then to form the mixture into a sheet of transfer tape, or any other tape-like material. Techniques for making such materials are described in U.S. Pat. Nos. 4,596,746 and 4,563,329, both to Morishita et al, as well as in the aforementioned application to Schaefer et al; all are incorporated by reference. The abrasive particulates should be uniformly distributed throughout the powder metal matrix for optimum wear resistance, and should make up about 10–35 volume percent of the abrasive layer. One advantage of using a tape-like product is that it is easily cut into the size and shape which corresponds to the blade tip surface. The tape is then placed on the blade tip surface 12 and sintered to the surface 12 in a high temperature sintering process, which is described in more detail below. The sintering process must be closely controlled to obtain the necessary properties in the wear resistant layer 10, and to prevent degradation of the base metal blade properties. Of particular concern regarding base metal properties is that there be no recrystallization in the blade during sintering and that the amount of gamma prime phase growth in the blade must be minimized.

The most important properties which the sintered abrasive layer 10 must have, besides wear resistance, are creep strength and oxidation resistance. Both of these properties are significantly influenced by the composition and microstructure of the layer 10, the latter being particularly dependent upon the way in which the tape is sintered to the blade tip surface 12. Porosity should be minimized in the sintered layer 10, and the ceramic particulates 22 should be uniformly distributed throughout the thickness of the layer 10. Of course, the layer 10 must be securely bonded to the blade tip surface 12. For optimum creep strength, the matrix 24 must have a large grain size, meaning that the grains in the solidified matrix are larger than the size of the starting (unmelted) metal powder particles.

In order to achieve a dense matrix having a large grain size, some melting of the metal powder particles must take place during the sintering process. Thus, there must be liquid phase sintering, which must take place under closely controlled conditions. Tests have shown that if too little melting of the metal powder particles take place, the sintered metal matrix will contain some porosity, due to the inability of the melted metal to fill in the interstices between all of the unmelted powder particles. And if too much melting takes place, the ceramic particulates will have a tendency to float in the liquid, because the ceramic is less dense than the metal. If the particulates are able to float or otherwise move around to a considerable extent during the sintering operation, the desired uniform distribution of ceramic particulates within the sintered layer will not be achieved. Between about 50 and 90% of the powder particles should melt during the sintering process. Some melting of the powder particles is necessary as it results in interdiffusion between the particles and the blade tip surface, and produces a braze-type bond between the layer and blade tip on cooling.

The manner in which the temperature is raised during the sintering operation must be closely controlled for several reasons. First, the rate at which the temperature of the blade tip is raised must be controlled to control the rate at which the binder volatilizes from the tape. If the binder volatilizes too rapidly, as a result of too rapid a rate of temperature increase, the powder particles and abrasive particulates will be violently expelled from the tape, resulting in a non-useful layer. Secondly, the temperature must be uniform from the leading edge of the blade tip to the trailing edge, and there must be a sharp temperature gradient from the blade tip towards the blade root. Uniform temperatures (from the leading to trailing edge) are required to achieve equal amounts of powder particle melting, and homogeneous properties in the sintered tip. A sharp gradient is required to insure that only the tip portion of the blade is heated to the maximum sintering temperature, while the airfoil and root portions are maintained at relatively cooler temperatures. Temperature uniformity and the necessary gradients are achieved, in large part, by the use of induction heating apparatus and the refractory metal heat shield, both discussed in more detail below.

Figure 2:
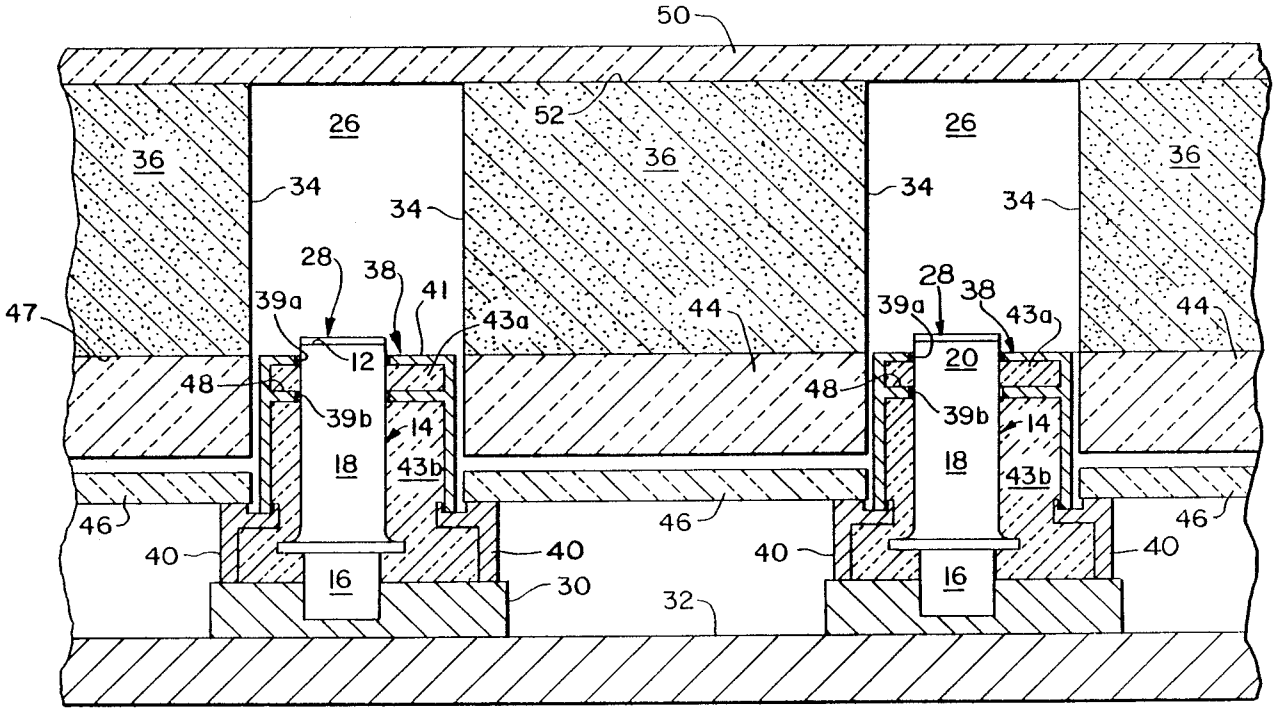

FIG. 2 shows a blade 14 positioned within a heating chamber 26 which sinters the abrasive carrying tape 28 to the tip surface 12 according to this invention. As described above, the tape 28 comprises abrasive particulates uniformly distributed within a matrix of superalloy powder particles. A resin type material binds the particulates and powder particles to each other.

Figure 3:
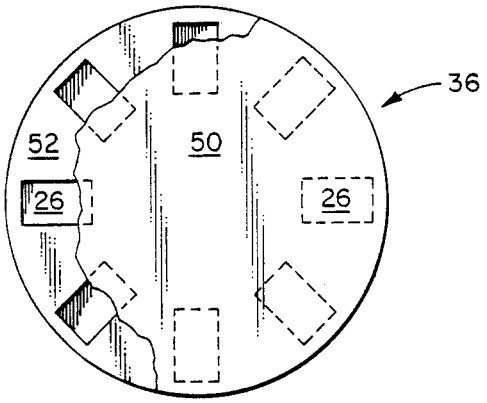
FIGS. 2–3 are simplified views of the apparatus used in the invention.

The heating chamber 26 is defined by slot walls 34 which extend through the thickness of a graphite susceptor 36. The susceptor 36 is inductively heated by low frequency (2,500–3,000 Hz) induction coils which are not shown in the Figure. Preferably, the susceptor 36 has a plurality of circumferentially spaced apart heating chambers 26, as shown in FIG. 3. To prevent oxidation or other such adverse reactions during the high temperature sintering process, the susceptor 36 is enclosed within a protective atmosphere chamber, preferably a vacuum chamber which is not shown in the Figures.

The blade 14 rests upon a support fixture 30 which is machined to receive the root portion 16 of the blade. The fixture 30 is disposed upon a heat sink 32 such as a water cooled copper chill plate. While the abrasive carrying tape 28 and blade tip portion 20 are heated by the susceptor 36 as described below, the heat sink 32 conducts heat from the blade, which maintains the blade 14 within a desired temperature range.

The temperature of the blade 14 during the sintering process is further controlled by insulation which shields the airfoil and root portions 18, 16, respectively, from the radiant heat source 36. In particular, a tantalum metal shield 38 surrounds the airfoil portion 18 of the blade 14, and rests upon a support 40 which extends from the blade root fixture 30. The shield 38 is a box-shaped structure having an airfoil shaped cut-out 39*a* in its top surface 4 through which the blade tip 12 extends. The shield 38 acts as a heat reflector, and also is stuffed with a heat insulative material 43 which provides, further protection for the airfoil and root portions of the blade 14. The shield 38 is preferably constructed from a sheet of thin tantalum metal, about 0.5 millimeters (0.02 inches) thick. Tantalum is particularly desired because of its excellent reflective characteristics, and because it is readily formed into complex shapes. The shield could also be made from other materials, including ceramics. Spaced slightly below the top surface 41 of the shield 38 is a shelf or support 48, also fabricated from tantalum, and which is joined (e.g., by spot welding) to the sides of the shield 38. The shelf 48 includes a cutout 39*b* through which the blade 14 extends; layers of graphite felt 43*a* rest upon the shelf 48, providing additional thermal protection to the shielded tip portion 20 of blade 14. FIBERFAX® insulation 43*b* (the Carborundum Company, Niagara Falls, N.Y.) fills the interior of the shield 38 below the shelf 48. Other suitable insulating materials will be apparent to those skilled in the art. Layers of rigid insulating materials 44, 46 also shield the blades 14, as well as the fixture 30 and heat sink 32 from the heat source 36. A first insulation layer 44 is secured to the lower surface 48 of the graphite susceptor 36, and second insulation layer 46 rests upon the support 40. A layer of rigid insulation 50 rests upon the top surface 52 of the susceptor 36.

At the beginning of the sintering process, the susceptor 36 is inductively heated t a temperature sufficient to heat the blade tip 20 to the desired maximum sintering temperature. Then, the chill plate 32 is moved into proximity with the susceptor 36, so that only the tip portion 20 of each blade 14 extends into its respective heating chamber 26, as shown in FIG. 2. The rate at which the blades 14 are raised into their heating chamber 26 is controlled, so that each blade 14 gradually reaches the maximum sintering temperature. A controlled rate is particularly important at the beginning of the process, to avoid an excessive rate of binder volatilization, as discussed above. Also, it is important to avoid thermally shocking the blade. After the tape 28 and blade tip 12 have been heated to melt between about 50–90% of the powder particles, the blades 14 are removed from their respective chamber 26 by movement of the chill plate 32. As the blades 14 cool, the molten metal powder particles solidify to each other and to the blade tip surface 12, to form a dense, wear resistant layer. The abrasive particulates are entrapped within the layer 10 as the metal powder particles solidify.

During the sintering process, the melted powder particles wet the tip surface 12 of the blade 14. Some melting and/or dissolution of the surface 12 likely occurs, similar to that which occurs during brazing processes. The resulting joint between the layer 10 and tip surface metallographically appears as a braze-like bond.

Process parameters which influence the success of the sintering process include the position of the blade 14 within the heating chamber 26 and the location of the various types of insulating material relative to the blade !4 and the heat source 36; and the rate at which the temperature is raised during the sintering operation. For example, if too much of the airfoil portion 18 of the blade 14 is directly exposed to the heat source 36, the blade may recrystallize or undergo excessive gamma prime phase growth. Alternatively, if too little of the blade 14 is radiantly heated, an insufficient amount of powder particle melting will take place, and the wear resistant layer 10 will not have the requisite properties.

Use of an inductively heated graphite susceptor permits for close control of the sintering temperature, and for close control of the rate at which the temperature of the tape 28 and blade tip 12 are increased. Both are necessary for the successful practice of this invention. Tests have shown that when a mixture of ceramic particulates and nickel base superalloy powder was heated by sources such as plasmas (e.g., with plasma spray apparatus), lasers, and electric arcs (e.g., with a tungsten inert gas welding apparatus), the amount of melting was virtually uncontrollable, and the distribution of particulates within the matrix was destroyed. Thus, techniques such as those described in U.S. Pat. No. 4,627,896 to Nazmy et al are not useful in the fabrication of a wear resistant layer.

While the exact relationships between the blade, the heat source, and the insulation will vary depending upon the particular materials and facilities used in making a wear resistant layer on a gas turbine engine component, the example discussed below is provided to illustrate one particular fabrication sequence. This example is meant merely to illustrate several features of the invention, as applied to a particular blade alloy, transfer tape composition, and radiant heating equipment.

The nickel base superalloy composition described in the aforementioned U.S. Patent to Duhl et al was melted and solidified to form a single crystal casting. The casting was removed from its investment casting mold, cleaned, and then machined to the desired length. After machining, the tip surface and airfoil walls within about 12 millimeters (0.5 inch) from the tip were electrolytically polished to remove plastic strain damage produced during the cleaning and machining operations; about 12 microns (0.5 mils) of material was removed. Then, a tape containing about 25 volume percent of 375 micron (15 mil) alumina coated silicon carbide particulates distributed throughout a nickel base superalloy powder matrix and METHOCEL® binder (Dow Chemical Company, Midland, Mich.) was affixed to the blade tip surface with NICROBRAZ® binder (Wall Colmony Corp., Detroit, Mich.). The nominal composition of the powder matrix was, on a weight percent basis, about 25Cr, 8W, 4Ta, 6Al, 1.2Si, 1Hf, 0.1Y, balance Ni. The powder particles were about minus 80 mesh, U.S. Sieve Series.

The blade was placed within a broach block upon a water cooled copper chill plate, and then a Fiberfrax filled tantalum shield placed over the airfoil portion of the blade, substantially as shown in FIG. 2. About 4 mm (0.25 in.) of the blade tip protruded above the top of the shield.

The blade was then raised at a controlled rate into an evacuated heating chamber within an inductively heated graphite susceptor; the temperature within the chamber was about 1,270° C. (2,320° F.). The susceptor was in a vacuum chamber which had been evacuated to a level in the range of about $10^{-6}$ mm Hg. The blade was raised partially into the chamber, such that the temperature of the blade near the blade tip increased at a rate of about 15° C. (27° F.) per minute between ambient conditions and about 480° C. (900° F.) This relatively slow temperature increase allowed the Methocel binder in the tape to slowly volatilize. Then, the blade was raised further into the chamber, until about the outer 4 mm was directly adjacent to the susceptor walls 34; the tip portion temperature then increased at a rate of about 250° C. (45° F.) per minute. After the blade tip reached 1,270° C. and was held at 1,270° C. for 15 minutes, the blade was removed from the chamber, which caused the melted powder particles to solidify.

Metallographic examination of the sintered layer and the blade itself revealed that at the interface between the layer and the blade tip surface was a braze-like bond joint, which indicated that some amount of interdiffusion between the elements in the metal matrix and the elements in the blade alloy took place. It also indicated that a small amount of melting took place at the tip surface. The amount of such melting was considered acceptable, and is believed to be preferable for optimum bond strength. Metallographic examination also revealed a uniform distribution of silicon carbide particulates within the layer, and some remnants of unmelted metal powder particles. It appeared that less than about 10% of the powder particles did not melt during the sintering process.

No recrystallization of the blade was evident. Some of the gamma prime phase near the blade tip was larger than that found in the airfoil portion of the blade; however, the size of this enlarged gamma prime phase was considered to be acceptable.

Figure 4:
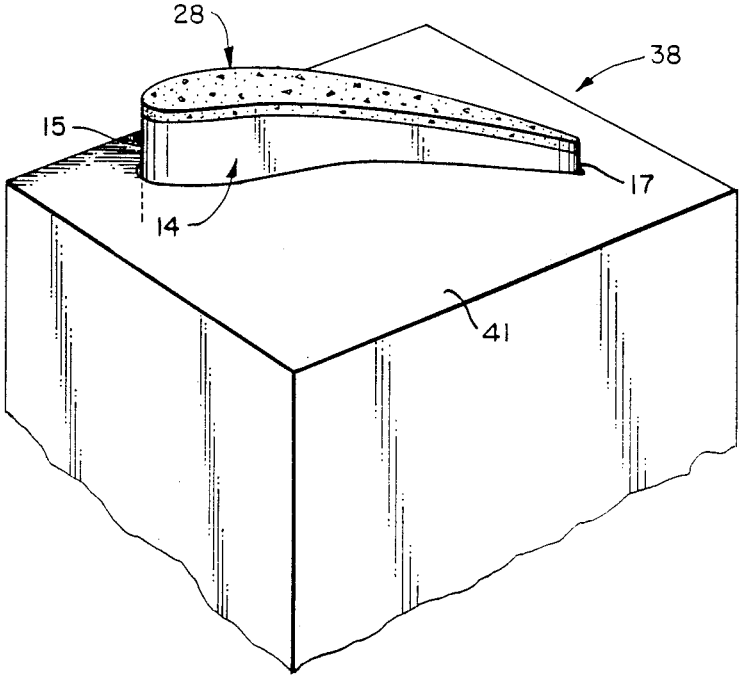
FIG. 4 shows the orientation of the refractory metal shield relative to the blade tip.

Tests were also conducted to determine the abilities of the reflective shield to control the temperature of blade during the sintering cycle. In particular, these tests determined whether the sintering cycle could be successfully carried out without the blade being cooled by conduction techniques (by contact with the chill plate) while it was being heated in the susceptor. Process parameters similar to those discussed above were utilized in these tests. The results of these experiments indicated that in order to achieve a uniform temperature across the tip portion of the blade (meaning that the temperatures at the leading and trailing edges were within about 2° C. of each other) the top surface of the shield had to be skewed with respect to the surface of the blade tip, as shown in FIG. 4, which is drawn slightly out of scale for clarity. In particular, in tests where the thickness of the blade ranged from about 2.3 mm (0.09 in.) near the trailing edge to about 5.8 mm (0.23 in.) near the leading edge, uniform tip temperatures were achieved when the shield exposed about 3.2 mm (0.125 in.) of the airfoil portion near the trailing edge and about 6.4 mm (0.25 in.) of the airfoil portion near the leading edge. These tests showed the influence of there being a greater amount of mass at the leading edge than at the trailing edge; they also show that the relative amounts of airfoil which should be exposed by the shield at the leading and trailing edges is approximately inversely proportional to the thickness of the blade tip at the leading and trailing edges.

Although this invention has been shown and described with respect to a preferred embodiment thereof, it should be understood by those skilled in the art that various changes and omissions in the form and detail thereof may be made without departing from the spirit and scope of the invention.

We claim:

1. Apparatus for heating the tip portion of a turbine blade having a longitudinal axis, a root portion, and an airfoil portion, comprising:

an inductively heated graphite susceptor having means for defining a heating chamber for receiving the tip portion of the blade;

means for supporting the blade such that the longitudinal axis of the blade is aligned in the substantially vertical direction;

means for moving said support means in the vertical direction between a first support position to a second support position, such that in the first support position the blade tip is located within said heating chambers, and the airfoil and root portions are located outside of said heating chamber and in the second support position the blade tip, airfoil and root portions are all located outside of said heating chamber;

refractory metal shield means for surrounding and shielding the airfoil and root portion of the blade, said shield means constructed and arranged such that the top portion of the blade if unshielded and extends into said heating chamber when said support means is in said first support position; and means for providing a non-oxidizing heating atmosphere within each heating chamber.

2. The apparatus of claim 1, wherein said shield has longitudinally extending walls for surrounding the airfoil and root portion of the blade, and a shield top wall extending transversely between said longitudinal walls, wherein said shield top wall has a cutout therein through which the blade top extends, and wherein said shield top wall is skewed with respect to the surface of the blade tip.

3. The apparatus of claim 2 wherein said shield top wall is skewed with respect to the blade tip surface such that the blade leading edge extends above the shield top wall more than the blade trailing edge extends above said wall.

4. The apparatus of claim 3 wherein said shield is constructed from tantalum metal and is about 0.5 millimeters thick.

* * * * *

UNITED STATES PATENT AND TRADEMARK OFFICE

CERTIFICATE OF CORRECTION

PATENT NO. : 4,818,833

DATED : April 4, 1989

INVENTOR(S) : James D. Formanack et al.

It is certified that error appears in the above-identified patent and that said Letters Patent is hereby corrected as shown below:

In CLAIM 1:

On line 34, replace "chambers," with --chamber,--.

On line 42, replace "top portion" with --tip portion--.

On line 42, replace "if unshielded" with --is unshielded--.

In CLAIM 2:

On line 52, replace "blade top" with --blade tip--.

Signed and Sealed this

Seventh Day of November, 1989

*Attest:*

JEFFREY M. SAMUELS

*Attesting Officer*

*Acting Commissioner of Patents and Trademarks*